United States Patent [19]

Sedivec

[11] Patent Number: 4,754,239

[45] Date of Patent: Jun. 28, 1988

[54] WAVEGUIDE TO STRIPLINE TRANSITION ASSEMBLY

[75] Inventor: Darrel F. Sedivec, Lawrence, Mass.

[73] Assignee: The United States of America as represented by the Secretary of the Air Force, Washington, D.C.

[21] Appl. No.: 943,348

[22] Filed: Dec. 19, 1986

[51] Int. Cl.[4] ..... H01P 5/107

[52] U.S. Cl. ..... 333/26; 333/34

[58] Field of Search ..... 333/21 R, 26, 34

[56] References Cited

U.S. PATENT DOCUMENTS

| | | | |
|---|---|---|---|
| 3,483,489 | 12/1969 | Dietrich . | |
| 3,579,149 | 5/1971 | Ramsey . | |
| 3,638,148 | 1/1972 | Hallford et al. | 333/21 R X |
| 3,732,508 | 5/1973 | Ito et al. . | |
| 3,755,759 | 8/1973 | Cohn . | |
| 3,882,396 | 5/1975 | Schneider . | |
| 3,969,691 | 7/1976 | Saul . | |
| 4,143,342 | 3/1979 | Cain et al. . | |
| 4,651,115 | 3/1987 | Wu | 333/26 |
| 4,679,249 | 7/1987 | Tanaka et al. | 333/26 X |

OTHER PUBLICATIONS

Untitled description of a Waveguide to Microstrip transition.

IEEE Transactions on Antennas and Propagation, vol. AP-29, No. 1, Jan. 1981. "Microstrip Array Technology", by Robert J. Mailloux, John F. McIlvenna, and Nicholas R. Kernweis, pp. 25-37.

"Microstrip Antennas for Millimeter Waves", by M. A. Weiss, pp. 171-174.

Article by M. Arditi entitled "Characteristics and Applications of Microstrip for Microwave Wiring".

*Primary Examiner*—Paul Gensler

*Attorney, Agent, or Firm*—William G. Auton; Donald J. Singer

[57] ABSTRACT

The transition between a rectangular waveguide and a stripline is accomplished with an assembly which contains: a waveguide flange, a waveguide section, and a tapered wedge. The waveguide flange physically connects with the rectangular waveguide and the waveguide section. The waveguide section has the tapered wedge housed within it along its top, and is electrically connected to the ground planes of the stripline. The tapered wedge is electrically connected with the center conductor of the stripline, to provide a transition between the rectangular waveguide and the stripline. Optimum impedance matching and voltage standing wave ratio can be empirically determined in the assembly by inputting signals into the stripline or waveguide, and taking impedance measurements while moving a reflecting panel which rests behind the tapered wedge to different positions in the slotted waveguide section.

4 Claims, 2 Drawing Sheets

Fig. 1
PRIOR ART
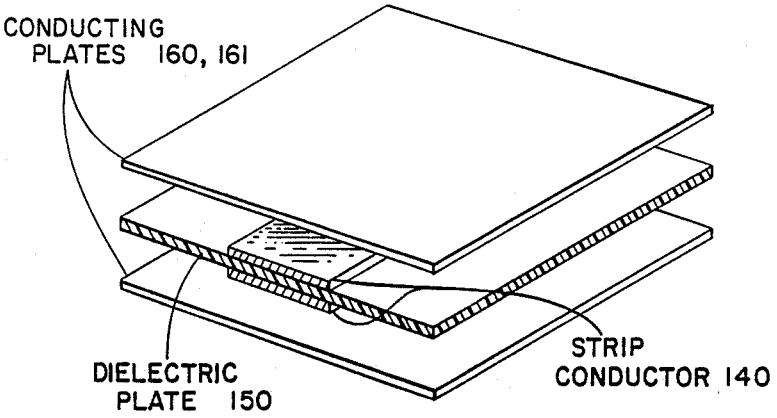
Fig.2
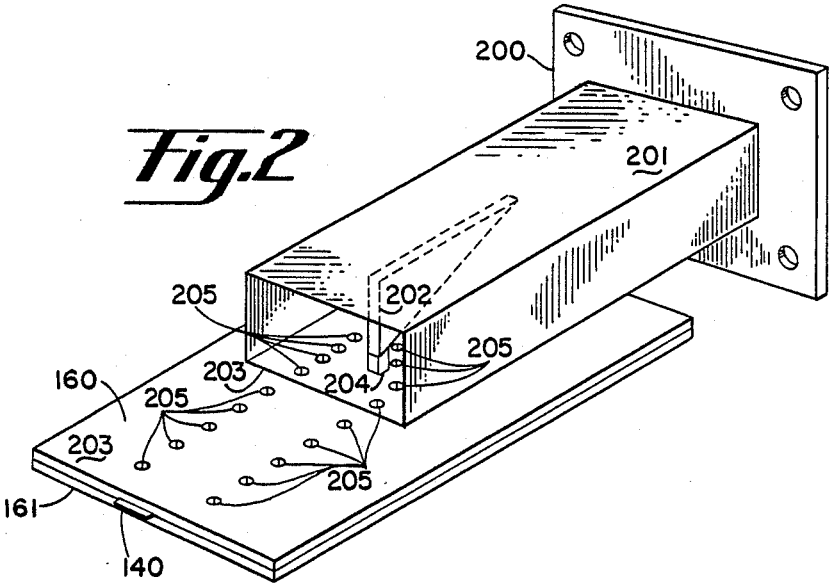
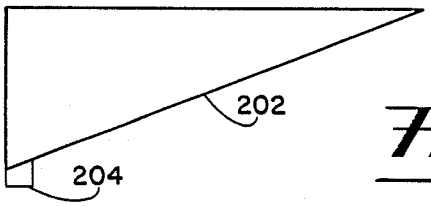
Fig.3

WAVEGUIDE TO STRIPLINE TRANSITION ASSEMBLY

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to the use of conductors in conjunction with waveguides, and more specifically to an assembly which is intended to interconnect a stripline conductor with a waveguide with optimum voltage standing wave ratio (VSWR) and impedance matching.

Systems which use rectangular waveguide radio frequency (RF) connectors all need a means for transitioning between transverse electric (TE) and transverse electromagnetic (TEM) modes. Great progress has been made for performing tranformations between TE and TEM modes in equipment which uses microstrips. However, in addition to microstrips, striplines have been developed for use with waveguides as a substitute for coaxial lines.

A microstrip consists of a strip conductor which is separated from a ground plane by a dielectric. A stripline is distinct from a microstrip in that a stripline has two conducting plates which are separated from each other, with a strip conductor fixed between them. The stripline is roughly equivalent to a flattened coaxial line, with or without dielectric filling. If striplines are to be used in conjunction with rectangular waveguides, a means of effectively coupling wave energy between waveguides and striplines is needed.

The task of coupling wave energy between waveguides and striplines is alleviated, to some extent, by the systems of the following U.S. Patents, the disclosure of which are incorporated by reference:

U.S. Pat. No. 3,483,489 issued to Dietrich;
U.S. Pat. No. 3,579,149 issued to Ramsey;
U.S. Pat. No. 3,732,508 issued to Ito et al;
U.S. Pat. No. 3,755,759 issued to Cohn;
U.S. Pat. No. 3,882,396 issued to Schneider;
U.S. Pat. No. 3,969,691 issued to Saul; and
U.S. Pat. No. 4,143,342 issued to Cain et al.

All of the references cited above are exemplary in the art of performing tranformation between TE modes and TEM modes. Particularly of note is the stripline to waveguide transition system disclosed in the Ito et al reference. Unfortunately, systems which rely on coaxial lines are not effective at frequencies greater than 40 GHz because of the possibilities of undesirable TE and TM moding due to tight tolerances and size requirements. There remains a need for an efficient waveguide to stripline transition for transformation from the TE mode to the TEM mode at frequencies of around 10 GHz as well as EHF (higher than 40 GHz). The present invention is intended to satisfy that need.

SUMMARY OF THE INVENTION

The present invention is an assembly which provides a waveguide to stripline transition which effectively couples transmitted waves from a rectangular waveguide into a stripline. One embodiment of the invention use a waveguide section in which a tapered wedge is mounted; and a means for tuning the device by moving the wall behind the tapered wedge within the opening of the waveguide. The wall behind the tapered wedge has a reflecting panel and is moved to desired positions by a handle.

The tapered wedge can be of the same thickness as and is electrically connected with the center stripline conductor. The outer edges of the waveguide section are electrically connected with the ground conductor of the stripline. Optimum impedance matching and voltage standing wave ratio is achieved by tuning the transition assembly. This tuning is accomplished empirically by inputting a signal into the stripline or waveguide and making impedance measurements while moving the wall behind the tapered wedge incrementally into the slotted waveguide section. In one embodiment, the waveguide supported a 50 ohm load. When an optimum setting of the wall behind the tapered wedge is reached, the wall can be fixed in that position.

It is an object of the present invention to provide an assembly which presents an efficient waveguide to stripline transition.

It is another object of the present invention to provide an effective transformation from the TE to the TEM or TEM to TE mode at frequencies approaching EHF.

It is another object of the present invention to provide a tunable waveguide to stripline transition assembly.

These objects together with other objects, features and advantages of the invention will become more readily apparent from the following detailed description when taken in conjunction with the accompanying drawings wherein like elements are given like reference numerals throughout.

BRIEF DESCRIPTION OF THE DRAWINGS

FIG. 1 is a detailed illustration of a segment of conventional stripline;

FIG. 2 is an illustration of an embodiment of the present invention;

FIG. 3 is a side view of the tapered wedge of FIG. 2; and

DETAILED DESCRIPTION OF THE PREFERRED EMBODIMENT

Figure 4:
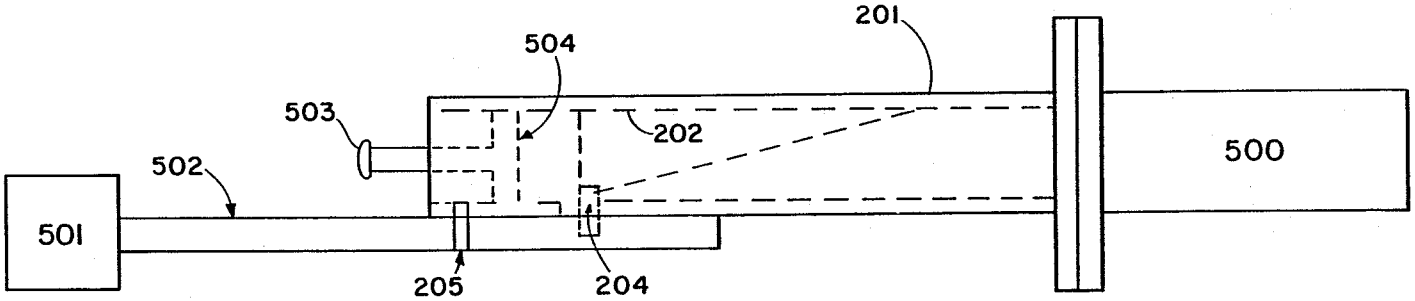
FIG. 4 is a side view of the preferred embodiment of the present invention.

The present invention is an assembly which provides a waveguide to stripline transition which effectively couples signals from a rectangular waveguide to a stripline at frequencies approaching EHF (greater than 40 GHz).

The reader's attention is now directed towards FIG. 1 which is a detailed illustration of a segment of conventional stripline. This stripline has a center conductor 140 surrounded by a substrate of dielectric material 150. The dielectric used is commonly ceramic or glass. Above and beneath the dielectric substrate 150 are ground planes 160 and 161 which are bonded to the dielectric.

FIG. 2 is an illustration of an embodiment of the present invention, which is used to effectively couple the stripline of FIG. 1 to a rectangular waveguide. The transition assembly of FIG. 2 has a waveguide flange 200, which physically connects the assembly to a rectangular waveguide, a waveguide section 201, a tapered wedge 202, and a bottom plate of the waveguide 203.

The bottom plate 203 of the invention has a central aperture beneath the tapered wedge 202. Through this aperture a central conductor 204 connects the tapered wedge 202 to the strip conductor 140 of the stripline. It is recommended that the tapered wedge 202 and central conductor 204 all have the same width as the strip conductor 140 of the stripline.

The bottom plate of the invention also has a number of auxiliary apertures through which shorting pins 205 are inserted to electrically connect the waveguide section 201 of the invention to both conducting plates 160 and 161 of the stripline.

Note that the waveguide section 201 of the invention in FIG. 2 does not have the moving wall section or reflecting panel mentioned above. Strictly speaking the moving wall section and reflecting panel are not necessary to practice the invention. However, the use of the moving wall section as a means of tuning the waveguide section are discussed in the description of FIG. 4, presented below.

The waveguide section 201 of the invention was constructed of brass, but may be constructed of any of the materials which are currently in use in fabricating waveguides. It is recommended that the waveguide section 201 have the same interior dimensions as the rectangular waveguide to which the invention is connected. By "interior dimensions" it is meant that the cross-section are of the interior of the waveguide section should approximately equal the interior cross-section area of the rectangular waveguide to which the invention is connected.

FIG. 3 is a side view of the tapered wedge 202 of FIG. 2. In the present invention, the tapered wedge 202 is electrically connected to the center conductor 140 of the stripline, and should therefore have the same width as the center conductor. In one embodiment, the stripline had a central conductor of 0.010 inches in width. As a result, the tapered wedge was made of 0.010 brass shim stock. The central conductor in FIG. 3 is schematically illustrated, and is of ordinary thickness and width.

FIG. 4 is a side view of the preferred embodiment of the present invention which electrically couples a rectangular waveguide to a stripline 502. Optimum impedance matching and voltage standing wave ratio is made by a process of tuning the transition assembly. This tuning process is as follows. For example, by attaching an input 501 to the stripline, impedance and VSWR measurements are made while moving a reflecting panel 504 behind the tapered wedge along into the waveguide 201. The reflecting panel 504 behind the tapered wedge 202 is physically moved using a handle 503, which is connected to the reflecting panel and extends out of the assembly. The bottom of the tapered wedge 202 remains in contact with the center conductor 204 which is connected to the strip conductor of the stripline. The ground planes of the stripline are electrically connected to the waveguide 201 by shorting pins 205, as discussed earlier. When measurements indicate that the reflecting panel 504 is in a position which provides optimum impedance matching or optimum voltage standing wave ratio (VSWR), it can be fixed in that position either temporarily or permanently. Table 1, presented below, is an example of VSWR measurements actually made with a transition assembly of the present invention at frequencies of around 10 GHz.

TABLE 1

| Frequency (GHz) | VSWR |
|---|---|
| 12.0 | 4.5 |
| 11.75 | 1.6 |
| 11.5 | 1.4 |
| 11.25 | 1.9 |
| 11.0 | 2.4 |
| 10.75 | 1.7 |
| 10.5 | 1.2 |
| 10.25 | 1.22 |
| 10.0 | 1.6 |
| 9.75 | 1.7 |
| 9.5 | 1.65 |
| 9.25 | 1.26 |
| 9.0 | 1.08 |
| 8.75 | 1.05 |
| 8.5 | 1.24 |
| 8.25 | 1.3 |
| 8.0 | 1.5 |

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A transition assembly for electrically coupling a stripline to a rectangular waveguide, said stripline having a dielectric with a strip conductor fixed between a top ground plane and a bottom ground plane, said transition assembly comprising:

a waveguide flange which physically connects with said rectangular waveguide;

a waveguide section having opposite ends which is connected to said waveguide flange at one of said ends and has a bottom plate which is electrically connected to said top ground plane of said stripline;

a tapered wedge which is housed in said waveguide section, said tapered wedge being electrically connected to said strip conductor to provide a transition between said stripline and said rectangular waveguide; and a means of tuning said transition assembly for optimum impedance matching and voltage standing wave ratio, said tuning means comprising a movable reflecting panel located between the other of said ends and said tapered wedge, said movable reflecting panel being capable of being positioned to different positions within said waveguide section.

2. A transition assembly, as defined in claim 1, wherein said tuning means further comprises a handle which is connected to said moveable reflecting panel and extends out of said waveguide section, said handle thereby allowing said moveable reflecting panel to be incrementally moved within said waveguide section until optimum impedance matching and voltage standing wave ratio are reached.

3. A transition assembly, as defined in claim 2, wherein said tapered wedge comprises a triangular wedge cut from brass stock and said brass stock has approximately the same width as the strip conductor of said stripline.

4. A transition assembly, as defined in claim 3, in which the waveguide section has an interior cross-section area which approximately equals that of said rectangular waveguide.

* * * * *